United States Patent [19]

King et al.

[11] Patent Number: 5,040,592

[45] Date of Patent: Aug. 20, 1991

[54] METHOD AND APPARATUS FOR SEPARATING CONTINUOUS CAST STRIP FROM A ROTATING SUBSTRATE

[75] Inventors: Edward L. King, Trenton; Donald W. Follstaedt, Middletown; Richard C. Sussman, West Chester, all of Ohio

[73] Assignee: Armco Inc., Middletown, Ohio

[21] Appl. No.: 543,615

[22] Filed: Jun. 22, 1990

[51] Int. Cl.[5] ..... B22D 11/06

[52] U.S. Cl. ..... 164/463; 164/423; 164/429; 164/479

[58] Field of Search ..... 164/463, 423, 429, 479

[56] References Cited

U.S. PATENT DOCUMENTS

| | | | |
|---|---|---|---|
| 2,847,737 | 8/1958 | Brennan | 22/57.2 |
| 3,576,207 | 4/1971 | Grenfel | 164/48 |
| 3,939,900 | 2/1976 | Polk | 164/27 |
| 4,142,571 | 3/1979 | Narasimhan | 164/88 |
| 4,184,532 | 1/1980 | Bedell | 164/64 |
| 4,221,257 | 9/1980 | Narasimhan | 164/87 |
| 4,301,854 | 11/1981 | Bedell | 164/479 |
| 4,301,855 | 11/1981 | Suzuki | 164/254 |
| 4,479,528 | 10/1984 | Maringer | 164/423 |
| 4,561,488 | 12/1985 | Niyama | 164/463 |
| 4,644,999 | 2/1987 | Bedell | 764/463 |
| 4,770,227 | 9/1988 | Sporenberg | 164/423 |
| 4,776,383 | 10/1988 | Heinemann | 164/423 |
| 4,789,022 | 12/1988 | Ohno | 164/463 |
| 4,913,220 | 4/1990 | Dickson | 164/463 |

FOREIGN PATENT DOCUMENTS 232653 5/1984 Japan .

*Primary Examiner*—Kuang Y. Lin

*Attorney, Agent, or Firm*—Larry A. Fillnow; Robert J. Bunyard; Robert H. Johnson

[57] ABSTRACT

The continuous casting of strip, ribbon and wire is improved by using a free jet nozzle which provides a fluid that follows a rotating substrate surface to the separation point. The nozzle includes an inclined surface having a ratio of its length to the gap between the substrate and the nozzle edge of 5:1 to 15:1. The inclined surface improves the ability of the jet to tangentially follow the substrate in a direction opposite to its rotation to the separation point. This also allows a close positioning of the nozzle to the substrate which serves to provide a back-up mechanical separation means by using the edge of nozzle lip. The nozzle may be rotated from its operating position for cleaning of the substrate and the nozzle.

19 Claims, 2 Drawing Sheets

METHOD AND APPARATUS FOR SEPARATING CONTINUOUS CAST STRIP FROM A ROTATING SUBSTRATE

The Government of the United States of America has right in this invention pursuant Contract No. DE-FC07-88ID12712 awarded by the U.S. Department of Energy.

BACKGROUND OF THE INVENTION

The present invention relates to the continuous casting of molten metal onto the surface of a chilled metal surface which is rotated to produce rapidly solidified strand. The cast strand may be crystalline or amorphous and the strand produced may be a narrow ribbon, wire or strip of various widths. The solidified strand exits from a rotating surface which could be a water cooled wheel, drum or belt. To insure the strip exits the substrate at a specific location to permit coiling, various means to separate the strip from the substrate have been used.

It is generally known to use mechanical means referred to as stripper bars to assist in the separation between the molten metal and the rotating chilled surface. U.S. Pat. No. 4,644,999 shows a device 22 which directs the strip off a casting wheel and to a coil winder. The separation means also provides direction for the strip to the coiler.

Another example of a mechanical scraper or knife is shown as 18 in U.S. Pat. No. 4,789,022 which serves to separate the metal strip from the solidification support.

Wedge-shaped blocks have scraped strip from a wheel for a long time as demonstrated by U.S. Pat. No. 2,847,737 which has a stripper shoe 14 for this function.

U.S. Pat. No. 4,770,227 uses a similar wedge-shaped releasing member 7.

U.S. Pat. No. 4,301,854 lists several solutions to stripping cast strip from the inner surface of a chill roll. Included were the use of fluid jets, scraper blades, brushes, magnetic devices and suction means to lift the filament from the chill roll.

The prior work of most interest to the present invention is the use of gas or fluids to cause the separation of the cast strip from the rotating substrate surface. An example of patented work in this area is U.S. Pat. No. 4,301,855 which uses a nozzle 7 to blow a gaseous medium tangentially to the roll surface in a direction opposite the rotation of the roll. The nozzle is positioned to be at a circumferential location on the roll where the molten metal is solidified.

In U.S. Pat. No. 4,776,383 a stripper nozzle 90 is used to detach the strip from the drum and may use air or protective gas as the fluid.

Japanese patent publication No. J59232653 blows a gas to peel the cast strip from the roll.

U.S. Pat. No. 4,221,257 blows inert gas in the direction of substrate rotation ahead of the molten pool to improve the casting conditions but is not intended for the removal of strip from the substrate.

The previously mentioned references have attempted to improve the separation of the cast strip from a rotating surface through several means which have not been entirely successful. If the adhesion of the strip is not broken prior to a complete revolution of the wheel, a catastrophic failure condition occurs.

The prior attempts to use fluid separation means have not provided a high pressure gas nozzle which may be closely positioned to the rotating substrate. Close positioning of the nozzle has a high risk for damage from the strip which is rotating around the substrate. Any strip build-up on the substrate may contact the nozzle if positioned too close. There is a considerable need for a system which can be used to remove cast strip from the substrate safely.

SUMMARY OF THE INVENTION

The present invention provides a method and apparatus which directs the flow of a fluid from a nozzle around the periphery of the rotating substrate to separate cast strip from the substrate in a safe manner. The present invention provides a fluid jet which may be closely positioned to the substrate without fear of strip coiling accidents and provides strip separation over a wide range of conditions from the same nozzle location.

The nozzle of the present invention differs from previous nozzles because the nozzle is not aimed directly into the area of contact between the strip and the substrate at the strip separation point. The nozzle opening provides a high pressure free jet which exits the opening and follows an inclined or curved surface on the nozzle. The free jet flows along this connecting surface and tends to attach itself to the surface. A nozzle which has been found to be particularly beneficial has a slope of 45° from the opening and a spacing of about 0.025 inches (0.625 mm) between the edge of the sloped surface and the rotating substrate. The distance from the wheel is selected based on the strip thickness being cast. The nozzle edge must be closer to the substrate than the strip thickness. The fluid follows the curved substrate up into the separation area. The present nozzle design also combines the ability to function as stripper bar for mechanical separation by positioning the discharge edge of the nozzle closer to the substrate than the thickness of the strip being cast to control build-up on the wheel or prevent damage to the casting equipment should solidified strip not be collected properly.

DESCRIPTION OF THE PREFERRED EMBODIMENTS

For the purpose of the description of the present invention, the reference to the term strip is to include a strand which may be wire, ribbon, sheet and the like and may be of any cross sectional shape. The composition may be crystalline or amorphous metal when solidified. The invention is not limited to any particular casting method and may be used in combination with well known methods such as melt overflow, melt drag, twin-roll, belt, planar flow and others. The fluid separation nozzle may be used with any casting system wherein a strand is being cast on a rotating substrate and removed from the substrate before a complete revolution is made.

Cast strip has the tendency to stick to the substrate on which it solidifies. While various surface treatments to the substrate, such as texture, lubrication, roll treatments and cleaning, may reduce the sticking tendency, a positive separation system is required to insure the adhesion does not cause a break in the continuous operation and insure high casting speeds.

The present invention provides the ability to raise the strip off the substrate pneumatically in a manner which provides a more reliable and safe separation with a broad range of flexibility. This is obtained by using a fluid device which indirectly forces the fluid into the separation area and includes a stripper bar edge on the nozzle. A free jet exits the nozzle of the invention which is designed to allow the fluid to follow the surrounding nozzle surface and attach itself to the rotating substrate. The angle of inclination of the nozzle is controlled to cause the fluid to flow along the desired path. The interaction with the surrounding atmosphere molecules and the free jet develops a partial vacuum between the jet and the inclined surface. The partial vacuum is at a pressure which is less than the surrounding pressure and causes the jet to attach itself to the surface. The pneumatic stripper device has a great deal of freedom in the exact position location since the fluid follows the rotating substrate up to the separation point. This feature allows the fluid nozzle to be positioned almost at any position around the substrate and still provide a separating force at the point the strip exits the substrate. The nozzle edge does not have to be positioned close to the substrate for the fluid to jump to the substrate. Close positioning of the nozzle allows the nozzle edge to perform the mechanical stripping function. The use of this fluidic principle will now be discussed in terms of the figures of the present invention.

Figure 1:
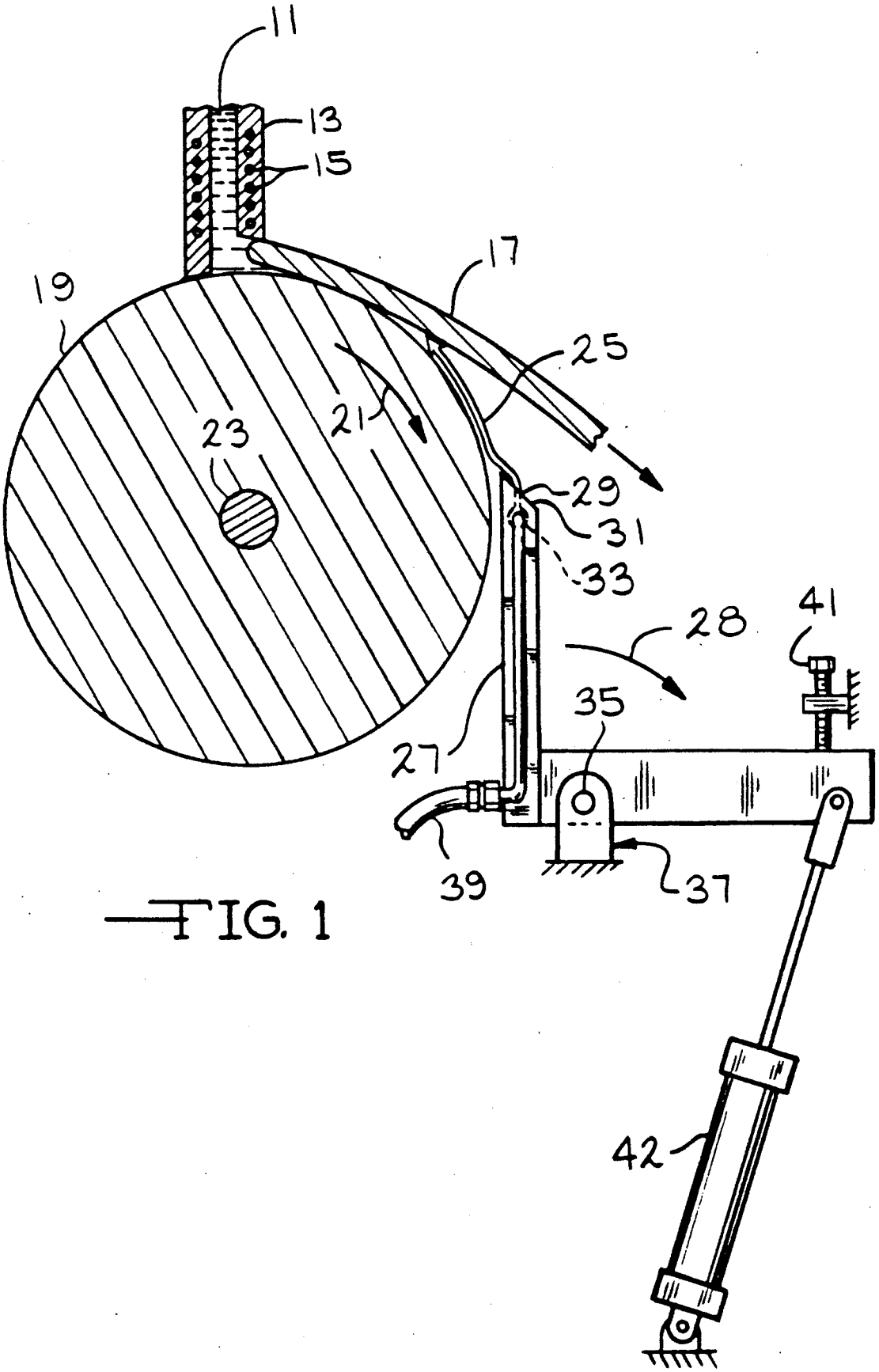
FIG. 1 is a diagrammatic side elevation with a portion in cross section of an apparatus for casting strip on a rotating wheel using a fluid separation nozzle of the invention.

FIG. 1 represents an example of a strip separation system with a relatively simple casting operation. Molten metal 11 is regulated through nozzle 13 which may be heated by means 15. The molten metal solidifies into strip 17 upon being cooled on substrate 19 which rotates in direction 21. The substrate 19 rotates about axis 23. The fluid nozzle 27 provides a free fluid jet 25 through an opening 29 in the inclined surface 31. The fluid is preferably an inert gas which prevents oxidation of the strip but any gas will cause a separation or lifting of the strip off the substrate. The fluid is released through the opening 29 from a plenum chamber 33 which is connected to a supply of fluid under pressure.

Figure 2:
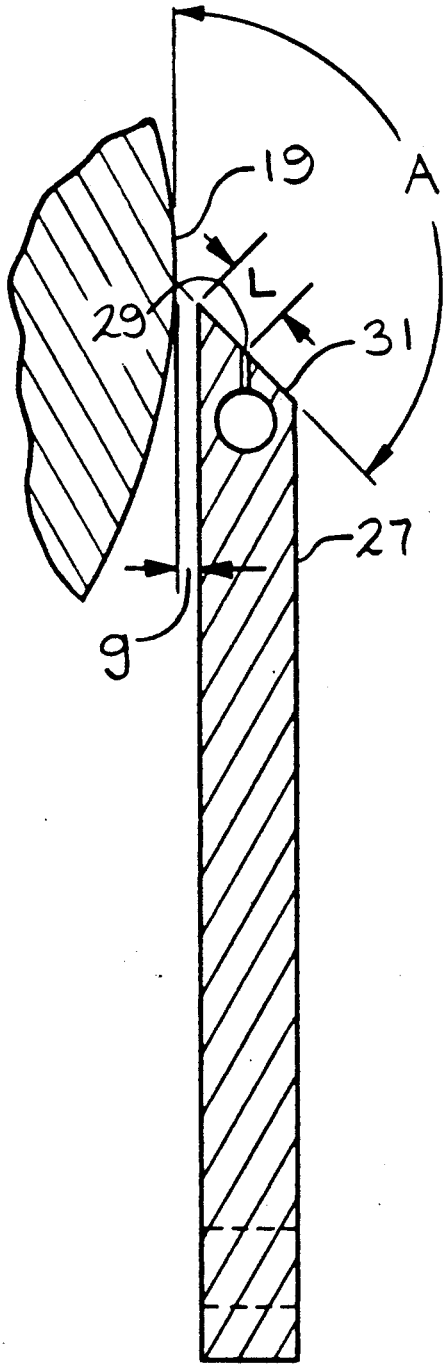
FIG. 2 is a cross-sectional side view of a fluid separation nozzle of the invention positioned adjacent a casting wheel.

The fluid nozzle 27 is shown in the activated position but may be rotated in the direction 28 to position the nozzle in a location removed from the substrate 19. This allows the substrate 19 to be surface treated more easily and allows the nozzle 27 to be cleaned if partially plugged by casting metal. Nozzle 27 rotates about axis 35 and is supported by support means 37. Nozzle 37 may be locked in place to prevent movement away from the substrate after the desired gap g is provided. Maintaining a uniform gap is important if the edge of the nozzle is an emergency stripper bar for removing strip attached to the substrate. Axis 35 may be located in one of several positions. If the axis 35 is located as shown in FIG. 2, any force of strip contacting the nozzle edge will urge the nozzle against the substrate. This could cause some damage to the substrate depending on the the strip material and substrate composition. However, this rotation does insure the casting equipment is not damaged. By positioning the axis 35 on the substrate side of the nozzle, the nozzle will tend to move away from the substrate and damage to the substrate is less likely. This location does not protect the casting equipment to the same degree during an emergency unless the nozzle is locked into position. The other position for axis 35 is directly below the nozzle in the final location. This would represent a neutral position and one which could be easily locked. The choice of axis rotation location would depend on space requirements, cost of equipment to be protected and other general relationships such as fluid supply lines.

The nozzle design of the present invention is different from other nozzles used in continuous casting of strip. The present nozzle does not have a central throat which channel strip directly into the center of the nozzle and split the nozzle in half. The present nozzle design has sufficient mass to prevent the mechanical edge from being broken by the strip if contacted and has an inclined outer surface which directs the strip away from the wheel but not into the center of the nozzle. The supply of fluid from the nozzle may actually be maintained during the use of the mechanical nozzle edge as a mechanical stripper.

Fluid is supplied to nozzle 27 by fluid supply means 39 which is connected to a fluid supply source not shown. Other means, such as internal channels, may be used to supply plenum chamber 33. Various positioning means may be used for the nozzle assembly. Adjustable stop means 41 and positioning means 42, such as an air cylinder, are shown for bringing the nozzle 27 to the desired distance from substrate 19 that is identified as gap g. Other well known mechanical, electrical and hydraulic means could be used to position the nozzle.

The location of the nozzle edge at the point of fluid discharge onto the substrate will be varied depending on the thickness of the strip being cast. As best seen in FIG. 2, the gap g between the substrate and nozzle edge will be less than the strip thickness to insure any strip which is not removed, does not rotate around the substrate past the point of the separation nozzle. The elongated nozzle opening 29 does not produce a high pressure fluid aimed at the separation area. The free jet emerges from the nozzle and sweeps along the periphery of the nozzle edge and substrate. The free jet is directed at the substrate with an angle A which is greater than 90° to produce a separating force which has the flexibility to follow the substrate in a direction counter to the rotation to the point where the strand exits the substrate. The slope of the nozzle inclined surface 31 also provides a smooth emergency removal surface for strip not removed by the fluid 25. The mechanical edge of a fluid nozzle positioned closer than the strip thickness provides a double strip removal system which insures a continuous casting operation with minimal chance for damage to the casting equipment from strip that is not coiled at the desired location.

It was surprising to discover with the design of the present nozzle that the fluid directed out of the nozzle slot did not maintain the exit angle of discharge but followed the angle of incline instead. This allowed very close positioning of the nozzle edge since the fluid did not have to be directed towards the substrate which previously pushed the nozzle away from the substrate and made very small gaps very difficult to maintain. The present nozzle design also gave an extremely broad range of positions since the fluid stream will keep following the substrate until it reaches the strip separation point from the separation. This provides more space around the lift-off area for coiling equipment or other equipment. The nozzles do not have to endure the extreme heat associated with close positioning to the strip at very high temperatures coming off the wheel.

The fluid nozzle to wheel distance g in FIG. 2 is determined based on the strip thickness, fluid pressure, general nozzle configuration and other factors. The distance is normally as close as possible to the substrate without risking contact due to slight build-up or wheel out of roundness. A typical gap for the fluid nozzle to substrate distance would be in the range of about 0.002 to 0.01 inches (0.05 to 0.25 mm) but this distance depends on strip thickness and roll build-up control desired. The nozzle could be maintained at a constant distance with the use of well distance sensors and control means connecting the nozzle to the distance to allow for roll roundness and strip build-up. The pressure relationship required for the free fluid jet is typically about 50 to 200 p.s.i. using an inert gas. The pressure requirements would vary with strip gage and location of the nozzle with respect to the location where the strip exits the substrate. The inclined surface 31 is preferably at an angle of about 45° sloped upwardly towards the substrate which produces an angle of about 135° to the substrate. However, any angle above 90° to the substrate would work. The inclined surface is machined to a smooth surface to reduce turbulence and, if needed, provide an emergency strip exit if the strip is not coiled above the fluid nozzle. The nozzle 27 should be generally aligned to have a uniform distance to the substrate across the nozzle width and have a lip or discharge edge which is removed a safe distance from the fluid opening. The discharge edge of the nozzle provides a back-up mechanical stripping means should the fluid not provide the desired pneumatic separating force or to control build-up on the substrate. The openings are typically about 0.01 inches (0.25 mm) but may range from about 0.005 to 0.05 inches (0.125 to 1.25 mm). Preferably the slot is wider than the strand being cast. The slot is normally rectangular in shape for strip casting. A general relationship of about 5:1 to 15:1 and preferably about 10:1 exists for the inclined length of the nozzle to the gap distance between the nozzle discharge edge and substrate. The inclined length L is defined by the distance from the fluid nozzle opening and the discharge edge and will range typically from about 0.025 to 0.75 inches (0.625 to 18.75 mm). Thus a gap g of 0.025 inches (0.625 mm) would have a typical inclined surface length of 0.25 inches (6.25 mm). Longer inclined surfaces between the opening and the substrate could be used since the fluid will follow the surface but there does not appear to be any substantial benefit except for strip runout during an emergency. Extending the length between the nozzle discharge edge and gas supply means would also reduce the chances for possible damage during the emergency use of the nozzle edge for mechanical scraping the strip off the wheel. The length of the inclined surface beyond the nozzle opening is not critical. The angle of incline is not extremely critical and may be selected to ease the machining of the surface. Preferably an angle of about 25°–75° which produces an angle of 115°–165° to the substrate is used and more preferably an inclined angle of about 30°–60° is used to provide a nozzle to substrate angle of about 120°–150°. An angle of 45° has been successfully used.

Figure 3:
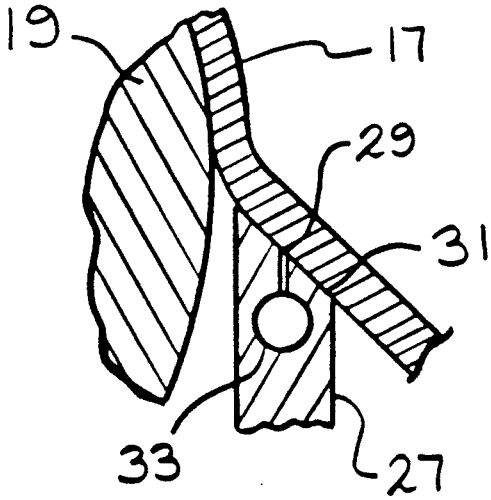
FIG. 3 is a cross-sectional side view of the nozzle of FIG. 2 showing the nozzle in a mechanical scraping mode.
Figure 4:
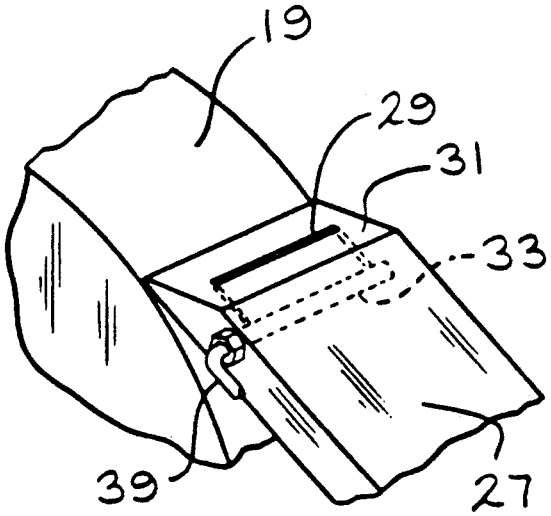
FIG. 4 is a perspective view of a fluid separation nozzle of the invention positioned adjacent a casting wheel.

The location of the separating nozzle with regards to the operating variables will remain relatively stable if the conditions are controlled. A steady state condition includes a temperature controlled substrate, uniform bath temperature, relatively homogeneous bath composition, a constant substrate rotational speed, control of build-up on the substrate and uniform surface conditions on the substrate. The thin fluid jet produced by the invention produces a separation force which covers a wide range of conditions and provides a safe operation for continuous strip production. The use of the fluid separation system of the present invention provides a thin gas boundary layer which facilitates a clean separation and also serves to provide emergency stripping means through the use of the nozzle edge. The nozzle position is possible because of the ability of the free jet to follow the substrate and does not have to be positioned close to the separation point. Because the jet is inclined to the substrate, the jet does not push the nozzle away from the substrate and also allows close positioning of the nozzle edge for acting as an emergency stripping means if the fluid force should fail. This feature is shown in FIG. 3 wherein the mechanical scraping and fluid separation features in a single fluid nozzle is shown. A different fluid supply connection means 39 is shown for providing a wiping fluid to the nozzle. The fluid source is not shown but easily connected to means 39 by those skilled in the art.

The use of gas to separate the strip from the casting roll should not be confused with numerous attempts to use a fluid to force the strip against the roll, to cool the strip for solidification, to adjust strip thickness or to assist in the direction of strip travel after the strip has already separated from the roll. While strip direction is also of importance to the present invention, the movement of the fluid is to lift the strip off the substrate and is directed towards the substrate in the present invention.

The present invention is not limited to the casting of any particular bath compositions or types of substrates. The following examples are not limiting on the scope of the invention but represent some of the possible conditions in use with the separation device.

The prior problems with variable separation from the substrate have been greatly reduced with the present invention. The present invention insures a safe separation of the strip from the substrate through the use of a fluid jet which follows the substrate to the point of separation and also provides an additional stripper edge as a back-up separation means. Whereas the preferred embodiment has been described above for the purpose of illustration, it will be apparent to those skilled in the art that numerous modifications may be made without departing from the invention.

We claim:

1. A method of continuous casting molten metal strand onto a cooled rotating substrate, the improvement comprising a tangential blowing of a pressurized free jet of fluid at an angle greater than 90° to the substrate from a fluid nozzle having a discharge edge spaced less than the thickness of said strand from said substrate for mechanical strand separation from said substrate, said free jet following the substrate in a direction opposite to said substrate rotation into a separation area between said cast strand and said substrate to pneumatically separate said cast strand from said substrate.

2. The method of claim 1 wherein said fluid nozzle discharge edge is spaced about 0.002 to 0.01 inches (about 0.05 to 0.25 mm) from said substrate.

3. The method of claim 1 wherein said nozzle has a slot opening of about 0.005 to 0.05 inches (about 0.125 to 1.25 mm).

4. The method of claim 1 wherein said nozzle has an inclined surface length of about 0.025 to 0.75 inches (about 0.625 to 18.75 mm).

5. The method of claim 1 wherein said nozzle has an inclined length to nozzle spacing ratio of about 5:1 to 15:1.

6. The method of claim 1 wherein said free jet is under a pressure of greater than 50 p.s.i.

7. The method of claim 1 wherein said nozzle has a discharge edge which makes an angle of 115° to 165° with said substrate.

8. The method of claim 1 wherein said continuous casting method is melt overflow.

9. The method of claim 1 wherein said nozzle is rotatable away from said substrate.

10. The method of claim 7 wherein said angle is 120° to 150°.

11. A method of separating a cast strand from a cooled substrate comprising providing a fluid jet nozzle having a distance to the substrate of about 0.002 to 0.01 inches (0.05 to 0.25 mm), an opening of 0.005 to 0.5 inches (0.125 to 1.25 mm), an inclined surface length of 0.025 to 0.75 inches (0.625 to 18.75 mm) and a discharge edge which makes an angle of 115° to 165° to the substrate, said discharge edge provides a mechanical backup separating means for strand removal from said substrate.

12. The method of claim 11 wherein said nozzle discharge edge is at angle of 120° to 150° to said substrate.

13. The method of claim 11 wherein said fluid is inert gas and has a pressure of at least 50 p.s.i.

14. A strip casting apparatus including means to supply molten metal, a casting nozzle connected to said supply means, a rotating substrate on which said molten metal is cast and strip removal means including a fluid nozzle having a mechanical scraping edge positioned less than said cast strip thickness from said substrate and a fluid discharge surface inclined at an angle greater than 90° to said substrate for conveying fluid in a direction counter to said substrate rotation from a fluid source means to a point where said strip is separated from said substrate.

15. A casting apparatus as claimed in claim 14 wherein said fluid nozzle edge is spaced about 0.002 to 0.01 inches (about 0.05 to 0.25 mm) from said substrate and has a slot opening of about 0.005 to 0.05 inches (about 0.125 to 1.25 mm).

16. A casting apparatus as claimed in claim 15 wherein said nozzle has an inclined surface length of about 0.025 to 0.75 inches (about 0.625 to 18.75 mm).

17. A casting apparatus as claimed in claim 16 wherein said inclined length is about 5 to 15 times the distance between said nozzle edge and said substrate.

18. A casting apparatus as claimed in claim 14 wherein said nozzle discharge surface is inclined at an angle of 115° to 165° to said substrate.

19. A casting apparatus as claimed in claim 14 wherein said fluid nozzle is rotatable towards said substrate.

* * * * *